US006550956B1

(12) United States Patent
Utracki et al.

(10) Patent No.: US 6,550,956 B1
(45) Date of Patent: Apr. 22, 2003

(54) EXTENSIONAL FLOW MIXER

(75) Inventors: Lechoslaw Adam Utracki, Pierrefonds (CA); André Luciani, Chavannes-prés-Renens (CH); Daniel Jude Joseph Bourry, Montreal (CA)

(73) Assignee: National Research Council of Canada, Ottawa (CA)

( * ) Notice: Subject to any disclaimer, the term of this patent is extended or adjusted under 35 U.S.C. 154(b) by 0 days.

(21) Appl. No.: 09/509,344

(22) PCT Filed: Sep. 29, 1998

(86) PCT No.: PCT/CA98/00901

§ 371 (c)(1),
(2), (4) Date: Jun. 13, 2000

(87) PCT Pub. No.: WO99/16540

PCT Pub. Date: Apr. 8, 1999

(30) Foreign Application Priority Data

Sep. 29, 1997 (CA) ..... 2217374

(51) Int. Cl.[7] ..... B01F 5/06
(52) U.S. Cl. ..... 366/176.2; 138/42; 138/43
(58) Field of Search ..... 366/176.1, 176.2, 366/336, 338, 339, 340; 138/40, 42, 43

(56) References Cited

U.S. PATENT DOCUMENTS

| | | | | | |
|---|---|---|---|---|---|
| 937,057 | A | * | 10/1909 | Mader | 409/169 |
| 1,551,672 | A | * | 9/1925 | Knollengerg | |
| 2,106,026 | A | * | 1/1938 | Gardner | |
| 2,504,678 | A | * | 4/1950 | Gardner | |
| 2,652,234 | A | * | 9/1953 | Feldman | 366/339 |
| 2,738,931 | A | * | 3/1956 | Schneider | 241/162 |
| 3,253,300 | A | * | 5/1966 | Gove et al. | 138/43 |
| 3,744,762 | A | * | 7/1973 | Schlicht | 366/338 |
| 5,406,981 | A | * | 4/1995 | Frederick | 138/40 |
| 5,437,308 | A | * | 8/1995 | Morin et al. | 138/40 |
| 5,451,106 | A | * | 9/1995 | Nguyen et al. | 138/42 |
| 6,299,342 | B2 | * | 10/2001 | Eggen et al. | 366/338 |

FOREIGN PATENT DOCUMENTS

| | | | |
|---|---|---|---|
| CH | 366 518 | * | 2/1963 |
| DE | 304 858 | * | 4/1918 |
| DE | 417 040 | * | 8/1925 |
| DE | 441 001 | * | 2/1927 |
| DE | 614 666 | * | 6/1935 |
| FR | 1 018 847 | * | 1/1953 |
| FR | 2 108 301 | * | 5/1972 |
| GB | 895 043 | * | 4/1962 |

* cited by examiner

*Primary Examiner*—Tony G. Soohoo
(74) *Attorney, Agent, or Firm*—Anissimoff & Assoc.; Hans Koenig

(57) ABSTRACT

An extension flow mixer especially for viscous liquids has a housing (10) with an end inlet (12*a*, 14*a*) connectable to a pressurized source of the liquid, and an outlet (119) at an opposite end of the housing (10). A mandrel (30) located in the cavity has protrusions (20', 32') with sloping side surface, the outer edges of which cooperate with the internal surface (114*a*) of the cavity to divide the cavity into a series of chambers separated by slits, such that liquid passes successively through all the chambers and slits in moving from the inlet (12*a*, 14*a*) to the outlet (119). The slits have cross-sectional areas which decrease in the liquid flow direction. The mandrel (30) sides have helical grooves (134) forming passageways with the housing wall (114*a*) which allow liquid to be distributed evenly around the edges of the mandrel (30) to the inlet end or upstream chamber. The mandrel (30) may rotate to provide additional shear mixing.

3 Claims, 3 Drawing Sheets

EXTENSIONAL FLOW MIXER

BACKGROUND OF THE INVENTION

1. Field of the Invention

The present invention relates to the mixing of liquids, particularly viscous liquids, for example plastic materials such as polymers, and especially the mixing of such materials having widely different viscosities, and when a minor phase is highly viscous. However, the invention can also be used for mixing other liquids, for example milk homogenization and preparation of mayonnaise in the food industry, preparation of explosive emulsions in the explosive industry, and homogenisation of molten soaps in the chemical industry.

2. Prior Art

One form of the present invention is an improvement of the motionless extensional flow mixer described in our U.S. Pat. No. 5,451,106, issued Sep. 19, 1995, which gives a detailed review of the prior art in this field.

Briefly, it is known to mix polymers by distributive mixing effected by so-called "motionless mixers" placed between a screw feeder and a die. In most cases these mixers have a number of alternating right and left-handed helical elements placed in a tubular housing equipped with temperature control. The energy for mixing is provided by the pressure loss across the mixer. The splitting and recombination of streams results in a predictable number of striations. The advantage of such mixers is that they are accessories to standard type of compounding or processing equipment, not their integral part, and their main disadvantages are lack of easy adjustment, limited effectiveness in mixing, and inability to provide dispersive mixing. The basic principle behind their design is division and recombination of the flow streams. Since the flow division is of the shear type, the dispersive forces are usually weak, limited to the cases where the two liquids show similar viscosity.

Theoretical calculations and experiments have shown that dispersive mixing of two Newtonian liquids is more efficient in extensional than in shear flow. Extensional flow occurs for example when fluid converges from a reservoir to a capillary. In shear flow fields it is impossible to disperse liquids that have viscosity higher than that of the matrix fluid by more than a factor of 3.8. By contrast, the dispersing capability of the extensional flow field is only slightly affected by the viscosity ratio. From the kinematics point of view, the extensional flow field engenders deformation much more rapidly (note the absence of vorticity in the elongational flow field). At a given stress level, the generated interphase (that is the accepted measure of adequacy of mixing or "mixedness") is orders of magnitude greater than that generated in shear. Similarly, the amount of energy required to generate a given degree of mixedness in elongation is orders of magnitude smaller than that in shear. Furthermore, the mechano-chemical degradation of the macromolecules is much less extensive in the elongational than in the shear field.

In spite of all these advantages present mixing equipment (including the twin-screw extruders) operates mainly in shear. This is due to the ease of designing equipment that operates on the shear flow principle. By contrast, it is difficult to envisage geometry that will engender very large deformations in the extensional flow field. However, one may by-pass this problem by designing a mixer in which the elongational flow field is engendered in a series of convergent-divergent geometries, preferably with semi-quiescent zones in between.

One prior patent describing an extensional flow mixer was U.S. Pat. No. 4,334,783 of Suzaka, which issued Jun. 15, 1982. The drawbacks of the Suzaka mixer are described in our aforesaid '106 patent. The mixer described in our '106 patent was intended to overcome these drawbacks, and to provide a mixer having the following characteristics:

1. The mixture of two fluids is exposed to strong extensional flow fields, each followed by a semi-quiescent zone;
2. The flow fields are generated by a series of convergences and divergences of progressively increasing intensity;
3. To reduce the pressure drop, as well as to prevent blockage of the restrictive openings, a series of holes (e.g. of the Suzaka design) are replaced by slits;
4. The slit gaps are made adjustable.

The mixer of our '106 patent has a series of chambers separated by several convergent/divergent surfaces providing narrow openings between the chambers. The openings are in the form of slits defined by the inner edges of protrusions formed on die members which provide the convergent/divergent surfaces. Also, the die members subject the liquids to gradually increasing stress, since the protrusions of the die members are concentric and are arranged so that during mixing the liquids pass radially inwards between the die members in passing from the inlet to the outlet of the mixer. At least one of the die members is made movable to adjust the slit gap, thereby adjusting the stress level.

In the design shown in our '106 patent, the movable die member is held at the lower end of a cylindrical block or mandrel which is slidable in a cylindrical chamber of a housing. Movement of the block, for adjustment of the gap width, is effected by rotating a wedge-shaped disc between an end of the housing and a sloping top end of the block. Passageways for the supply of the mixed liquids to the edges of the die members are formed around the sides of the block, and communicate with a side inlet into the housing. This construction has been found to have two drawbacks.

Firstly, when using high pressures in the mixer, for example 3,000 psi or 20 MPa, the liquid pressure at the side of the block adjacent the side inlet tends to tilt the block causing asymmetrical flow to the edges of the die members. Secondly, the wedge-shaped disc used to vary the slit gaps was difficult to adjust. The present invention overcomes these problems.

Another form of the present invention combines features of the '106 motionless mixer patent with some features of known dispersive mixers that are used in association with screw extruders, particularly single screw extruders, to improve the mixing capability of such extruders. Such mixers generally have a housing defining a cylindrical cavity with inlet and outlet ends, and a mandrel of generally cylindrical form which is rotatable in the cavity. The mandrel has protrusions which may resemble screw threads, but which are interrupted by gaps, or separated by other, discrete protrusions or indentations, so that the material being mixed is not merely progressed along the cavity, as in a screw extruder, but is also caused to move through slits between the outer edges of the protrusions and the inside surface of the cavity. The side surfaces of the protuberances provide convergent entrances into, and divergent exits from, the slits.

SUMMARY OF THE INVENTION

The extensional flow mixer of this invention is similar to that of our '106 patent in having:

a housing providing a cavity having an internal surface, and having an inlet into the cavity which inlet is connectable to a pressurized source of the liquids, the end of the housing remote from the inlet having an outlet for the mixed liquids;

a mandrel located in the cavity;

the mandrel carrying protrusions having side surfaces which converge towards their outer edges, the outer edges cooperating with the internal surface of the cavity to divide the space between the protrusions and the internal surface into a series of chambers separated by slits such that liquid passes successively through all the chambers and slits in moving from the inlet to the outlet, the side surfaces providing convergent entrances to, and divergent exits from, the slits, and the slits having cross-sectional areas which decrease in the liquid flow direction, from an upstream chamber adjacent the inlet, to the outlet; and means for adjusting the slit gaps.

To overcome problems with asymmetrical flow of liquids into the outermost cavity, in accordance with this invention the inlet into the housing is at an end of the housing, rather than at the side, and the mandrel has a side portion provided with helical grooves which cooperate with an interior surface of the housing to form helical passageways connecting the inlet to the upstream chamber for distributing the liquids to this chamber.

In a preferred embodiment, at least one helical groove is provided for each 25 mm of the mandrel diameter, each groove leading from an inlet end of the block mandrel to the vicinity of the upstream chamber.

In the mixer of our '106 patent, adjustment of the slit gaps was achieved by moving the block or mandrel, which carried one series of the protrusions. In accordance with another aspect of the present invention, the block or mandrel is stationary relative to a fixed part of the housing, and this fixed part of the housing is connected by screw threads to a relatively adjustable part of the housing. The relatively adjustable part may carry protuberances which cooperate with those of the mandrel to define the slits.

As indicated, one form of the present invention has features in common with known dispersive mixers having a housing defining a cavity which is usually of generally cylindrical form, and having a mandrel rotatable in the cavity, the mandrel having protrusions. However, the present invention differs from this prior art, firstly, in that the cavity is frusto-conical having a large end at the inlet and a small end at the outlet, and in that the protrusions are annular, and are such that said outer edges divide the space between the protrusions and the internal surface into a series of annular chambers separated by the slits such that liquid passes successively through all the chambers and slits in moving from the inlet to the outlet. The chambers have a mean diameter which decreases from an outermost chamber adjacent the inlet to an innermost chamber adjacent the outlet.

This form of the invention may also include screw thread means for adjusting the axial position of a portion of the housing relative to the mandrel to alter the slit gaps. Also again, the mandrel may have, adjacent the inlet, a side portion provided with helical grooves, the grooves forming helical passageways with an interior surface portion of the housing, the passageways communicating with the upstream chamber. This dynamic form of the invention, termed a dynamic extensional flow mixer (DEFM), has all four elements which constitute the fundamental principles of the invention: strong, elongational flow fields, increasing in intensity in the downstream direction, and the use of slits which are adjustable.

In this form of the invention, the fact that the mandrel rotates adds angular shear to the mixing; this is desirable as it prevents an elongated droplet from returning to a spherical shape.

BRIEF DESCRIPTION OF THE DRAWINGS

Preferred embodiments of the invention will now be described by way of example with reference to the accompanying drawings, in which.

DETAILED DESCRIPTION

Figure 1:
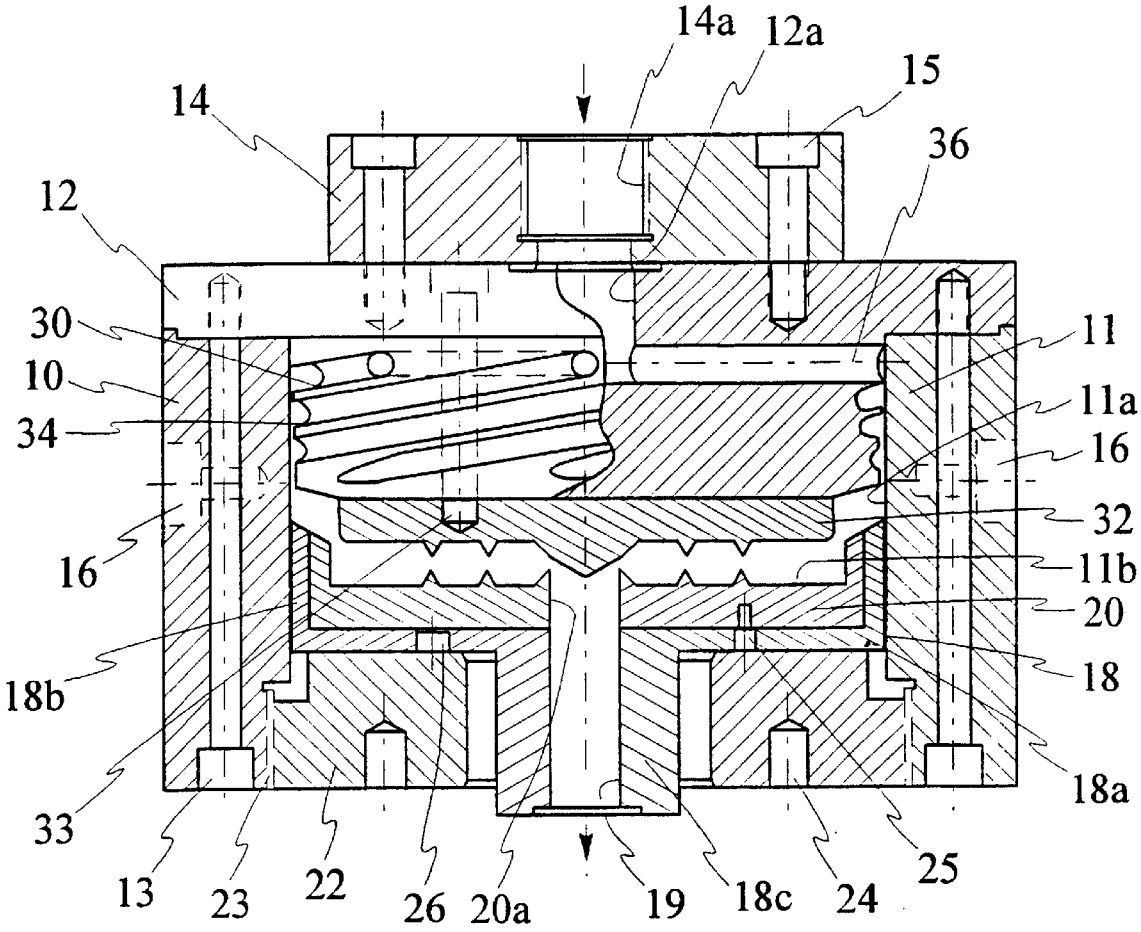
FIG. 1 is a sectional elevation of one form of mixer of the motionless type.

As shown in FIG. 1, the mixer has a cylindrical housing 10 with a removable top plate 12 held on by bolts 13 which extend up from the bottom of the housing through the length of its cylindrical side wall. An adapter plate 14 is fixed to the top of the plate 12 by bolts 15. The plates 12 and 14 have aligned axial bores 12*a* and 14*a* which together provide an axial inlet into the end of the housing. The upper end portion of bore 14*a* is threaded to receive an adapter (not shown) connected to an extruder which delivers viscous liquids at required pressure to the inlet. The mixer is supported by a support yoke fixed to the mixer by support rods inserted into side bores in the housing; the position of these side bores, which are located between the bolts 13, is indicated at 16. The housing 10 also carries a pressure sensor (not shown), which is located at 90° to the sectional plane shown in FIG. 1.

The housing 10 surrounds a cavity having a cylindrical sidewall 11*a* and being closed at the top by the plate 12 and at the bottom by a movable end closure 18 which has a main disc portion 18*a* surrounded by side wall 18*b* which seal against the cylindrical side wall of the cavity, and having a downwards extending boss 18*c* provided with a central, axial outlet bore 19. This end closure 18 provides a holder for a first, movable die member 20 which provides an internal surface 11*b* for the end of the cavity, and which will be further described below with reference to FIGS. 2–4. The die member has a central outlet bore 20*a* communicating with outlet 19. The end closure is adjustably supported in the cavity by a disc-like adjusting plate 22 the outer edges of which are provided with fine screw threads 23 mating with internal threads of a lower end portion of the housing side wall. Side portions of the plate 22 are provided with four partial bores 24, parallel to the plate axis, two of which are shown, suitable for receiving projecting parallel spigots of a tool (not shown) which can be used to rotate the plate to adjust the axial position of the movable die. The threads 23 are fine enough to allow for fine adjustment of the plate position; suitable threads provide 2 mm of movement for each 360° of rotation of the plate.

The die member 20 is held in place in the end closure 18 by bolts 25 extending up through the main disc portion 18*a* of the closure into blind threaded bores in the die member. In addition, bores 26 are provided in the disc portion 18*a* to allow the die member to be knocked out of the closure by suitable tools, when replacement is needed.

The upper end portion of the housing cavity is occupied by a block or mandrel 30, the lower end of which carries the second, fixed, die member 32; again, details of this will be described in relation to FIGS. 2–4. The mandrel 30 is an integral part of the top plate 12. The die member 32 is fixed to the underside of the mandrel 30 by bolts 33 having their heads recessed into the top of the 20 plate and their lower ends engaged in blind threaded bores in the top of the die member 32.

The outer edges of the die member 32 are spaced within the inside surfaces of the closure wall 18*b*, allowing liquid to flow between these edges. The space between these edges communicates with passageways formed on the outside of the mandrel 30, and which communicate with the inlet 12*a*. Specifically, the outside surface of the mandrel is formed with several, for example four, equi-spaced side-by-side spiral or helical grooves 34, resembling a multi-start screw thread, each groove being of U-shaped cross section and having its outer edges close to or touching the cylindrical interior surface 11*a* of the cavity and each forming a passageway with this surface. At their upper ends the grooves each communicate with a radial passageway 36, several equi-spaced such passageways being provided, each of which communicates with a lower end portion of the inlet bore 12*a*.

Figure 2:
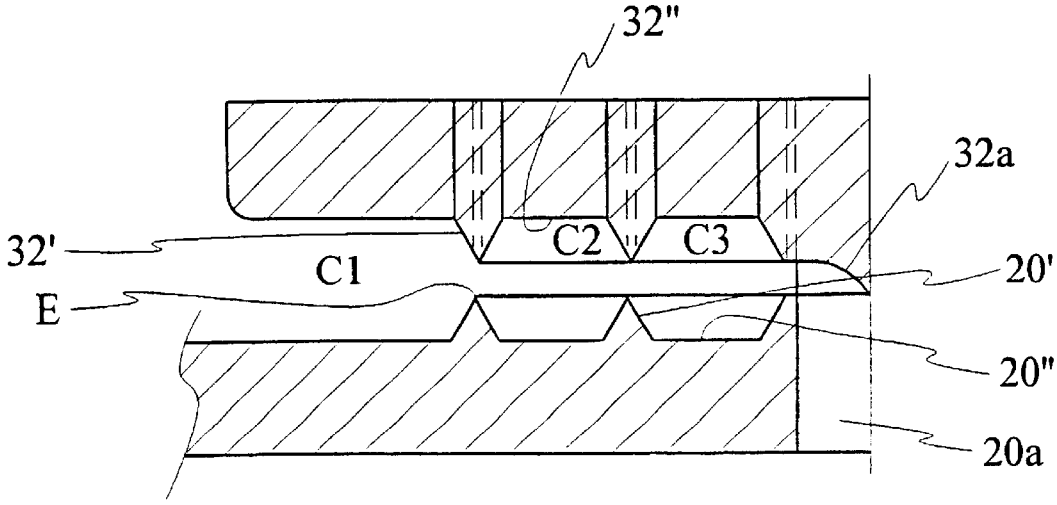
FIG. 2 is an enlarged sectional elevation of the die members of the FIG. 1 mixer.
Figure 3:
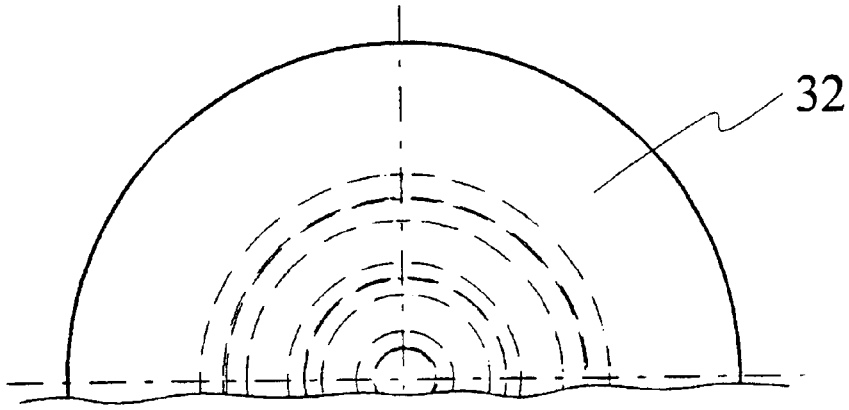
FIG. 3 is a partial plan view of the die plates of the same mixer.
Figure 4:
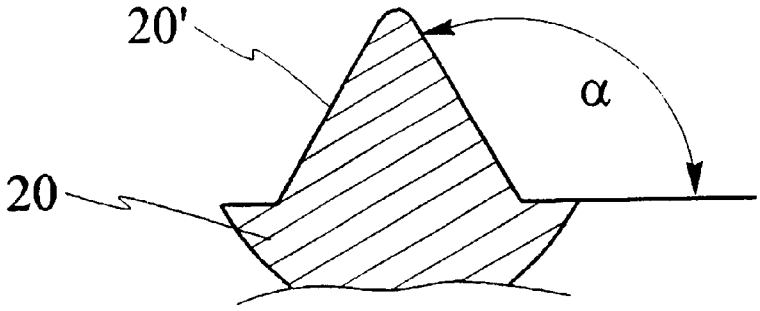
FIG. 4 is an enlarged view of a die of the same mixer.

FIGS. 2, 3, and 4 show details of the die members 20 and 32. These carry lower and upper symmetrically opposed protrusions 20', 32', these protrusions having opposed inner edges E separated by slits. The protrusions have sloping side surfaces adjacent these inner edges which provide converging entrances into the slits and diverging exits therefrom, and which define in part an inlet chamber C1 and two intermediate chambers C2 and C3. Typically, the sloping convergent/divergent surfaces lie at 60° to the generally horizontal plane of the overall flow of the liquids, i.e., angle $\alpha$ in FIG. 4 is 120°, although angles between ±15° of this preferred angle may be suitable. It will be seen that the die members provide parallel faces 20", 32", which define intermediate portions of the chambers between the dies, these portions being more than one half and preferably more than 70% the radial extent of the chambers. These provide semi-quiescent spaces. The slits are adjustable within a wide range by rotation of the adjustment plate 22, to provide convergence ratios (i.e., the ratio of chamber depth to slit gap, or the ratio of the spacing between the parallel faces to the spaces or gaps between the inner edges E of the protrusions) preferably of between 5:1 and 250:1. Accordingly, the transverse dimension of the intermediate portions of the chambers, as defined by the spacing between the parallel faces of the die members, is at least twice the slit gap. The lower die member 20 has its outlet bore 20*a* inwardly of chamber C3 leading to the outlet 19, while the upper die member 32 has a central boss 32*a* with a central projection shaped to divert the liquid towards the outlet.

The nature of the die members so far described is the same as that of the '106 patent. However, one difference over this previous patent, and which is illustrated in FIG. 4, is that there is a smooth transition of the slope from the sides of the protrusions to their inner edges E, i.e., the edges of the protrusions are rounded instead of having a sharp corner as in the previous patent. This is intended to eliminate the possibility of dead space or the deposition of immobile polymer at these corners.

In use, a blend of molten polymers enters the mixer from any pumping device, e.g., an extruder or gear pump, through an adapter attached to adapter plate 14. The melt passes from the bore 12*a* into the radial passageways 36, and then into the spiral passageways formed by the grooves 34 and the interior surface of the housing. The melt is smoothly distributed by these passageways, and is evenly distributed around the outer edges of the die members, a result not well achieved with the design shown in our previous '106 patent. The melt then flows from the rims of the die members towards the central outlet 19, undergoing convergent and divergent deformation before passing out through the bore 20*a* and outlet 19. The gaps between the inner edges of the protuberances can be adjusted by rotating the adjusting plate 22 using the tool having spigots which engage in the four holes 24 in this plate. The slit gaps can be controlled precisely within the range of from 0 to 3 mm. The pressure and temperature of the melt are continuously recorded by the sensor inserted into the melt through the side wall of the housing. The mixer can readily be mounted on a laboratory or an industrial extruder with a throughput of up to 1,000 kg/hr.

Apart from the even distribution of liquid to the edges of the die members given by the axial inlet and spiral passageways, other advantages of this design over that of the prior '106 patent are:

1. The design is sturdy, with little deflection caused by the high pressures used. The feed is uniform around the mandrel and does not generate any pressure gradient that may tend to tilt the mandrel. This is important since with a small slit gap, say of 50 microns, a deflection of only 5 microns is significant.
2. The melt stream is partly homogenized before reaching the die members, the melt temperature being more uniform.
3. Pressure drop in the melt distributer system, upstream of the die members, is relatively low, compared to the pressure drop across the whole mixer.
4. The machining of the mandrel, is relatively easy, compared to that needed to produce the special groove in the block of the former design.
5. The screw thread allows easy adjustment of the slit gap.

It may be noted that while it is desirable for both the die members 20 and 32 to have ridges, it is also possible to achieve extensional flow mixing with ridges only on one die member, this member facing a flat plate.

In some cases the motionless mixer as described above may not be convenient to install on the production line, and/or it may not provide adequate distributive mixing. For this reason the dynamic extensional flow mixer shown in FIG. 5 has been developed. This is shown as attached to the conventional barrel 101 and screw 102 of an extruder. The mixer includes a housing 110 the initial or upstream portion of which is a barrel extension 114 having a flange 114' attached to a flange of the extruder barrel 101, the upstream end of the extension defining an inlet 112*a* into the mixer. The extension has a retaining ring 115 which retains an inner flange of a rotatable sleeve 112, and this sleeve has internal screw threads 123 holding an upstream cylindrical portion 111*a* of conical mixing barrel 111 forming a downstream part of the housing 110. Below the retaining ring 115 a cylindrical portion 114*b* of the extension 114 engages an inner surface of the mixing barrel portion 111*a* via a sealing bushing 124; these portions are made non-rotatable relative to each other so that the axial position of the mixing barrel 111 can be adjusted by rotation of the sleeve 112 relative to extension 114.

The mixing barrel 111 defines a cavity having a frusto-conical inner surface 111*b* converging from an upper end to an outlet 119 at its small end. A mandrel 130 has an upper end adapter 130*a* connected to the screw 102; an upper portion 130*b* located within the cylindrical interior 114*a* of the extension 114; a main, lower portion 130*c* located within the cavity of the mixing barrel 111; and a lower end part 130*d* located close to the outlet 119 from the housing.

The upper end adapter 130*a* has a threaded bore by which it is attached to the lower end of the screw 102, so that the mandrel is caused to rotate with the screw. From its upper end this part decreases in diameter to meet the upper end portion 130*b*, which then expands to provide a short cylindrical part 130*b*' which fits closely within the interior surface 114*a* of the barrel extension 114, and then reduces in diameter to connect with a cylindrical connecting part at the upper end of the main mandrel portion 130*c*. The upper end portion 130*b* is provided with helical grooves 134 which cooperate with the interior surface 114*a* to form helical passageways connecting the inlet to a chamber surrounding the main portion of the mandrel.

The main mandrel portion 130*c* has several, for example three, three co-axial annular protrusions 132 which are of decreasing diameter so as each to have an outer edge close to the conical internal surface 111*b* of mixing barrel 111. The protrusions divide the space between the internal surface 111*b* and the mandrel into co-axial chambers C1, C2, C3 and C4. The spacing between the outer edges of the protrusions and the internal surface 111*b* is adjustable by rotation of the sleeve 112 to shift the axial position of the barrel 111. Since a small amount of axial movement of the barrel results in much smaller radial changes in the slit gaps, very fine adjustment is possible. Usually gaps of 0 to 4 mm. will be used. Typically, the barrel sides are inclined at between 10 and 15° to the barrel axis, and an amount of axial movement of 1 mm changes the slit gaps by about 170 to 270 micrometers.

While the drawing shows protuberances with apparently sharp outer edges, these will preferably be rounded, as shown in FIG. 4 for the first embodiment.

The downstream end portion 130*d* of the mandrel has an upstream flank increasing in diameter from chamber C4 to a short cylindrical section 130*d*', and a downstream flank decreasing in diameter with a slope slightly larger than that of the housing barrel 111. The two flanks are joined by grooves 140 which provide passageways between the last chamber C4 and the outlet 119.

In operation, this mixer provides both dispersive and distributive mixing, the former caused by the convergent/divergent flow of the liquid through gaps between the rotating members 132 and the extended barrel surface 111 b, i.e., the gaps separating chambers C1, C2, C3, and C4. The distributive mixing is ascertained by mainly shear flow of the melt through the grooves of members 130*b* and 130*d*. The pressure of liquids entering the inlet end of the mixer, via the grooves 134, causes the liquids to pass successively through the chambers C1 to C4, passing though all the slits in moving from the inlet to the outlet. Accordingly, the mixer works, in this sense, similar to that of the first embodiment. Also, as in the first embodiment, the length, as well as the areas, of the slits decreases as the liquids pass through the mixer, so that they are subjected to increasing extensional stress. Here, however, the mandrel is rotated by its connection to the extruder screw, and accordingly there are also shear forces between the rotating parts of the mandrel and the internal surface of the barrel, especially where the liquids are close to the protuberances. The amount of shear is however relatively minor, and not such as to cause degradation of mixed polymers.

Figure 5:
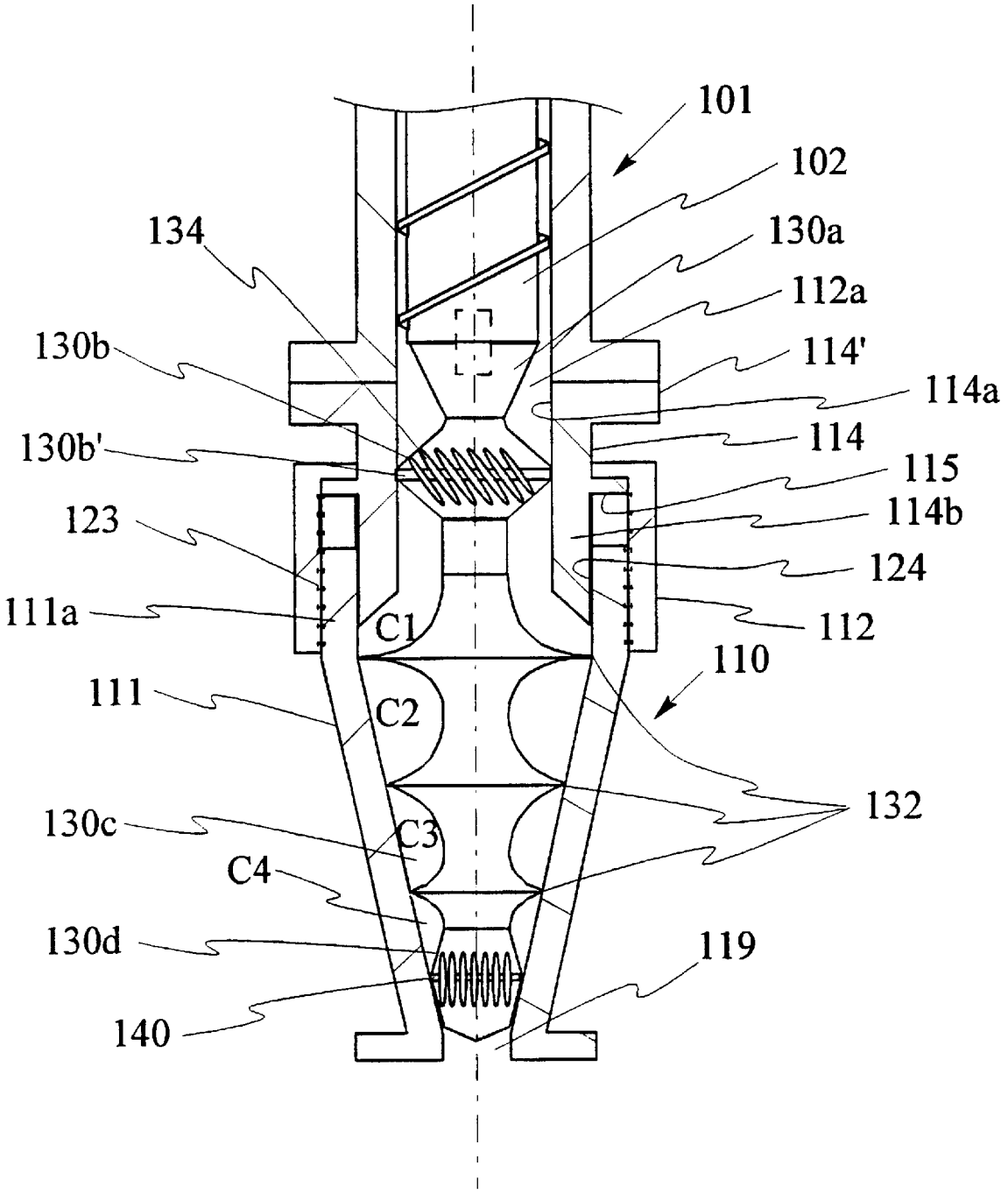
FIG. 5 is a sectional elevation of a dynamic extensional flow mixer (DEFM).

The FIG. 5 embodiment is easily scaled up and can be adapted for more stages. Unlike the first embodiment, the number of slits can be increased without undue increase in the diameter. Helical grooves can be provided not only in inlet member 130*b* but also in outlet member 130*d*.

The form of the mandrel shown in FIG. 5 also provides semi-quiescent zones, as in the first embodiment, where the liquid body is neither being strongly contracted or expanded. The shape and size of the chambers C1 to C4 can be optimised using the finite element flow modelling for the melt of typical viscoelastic characteristics.

The FIG. 5 embodiment does not need to be attached to a single-screw extruder, as shown, but may also be incorporated in a design using twin screws. Also, the mixer can be used as a stand-alone unit, having, if desired, its own independent power source, as well as an internal mixer in blow molding and injection molding machines. While the mixer will provide extensional flow mixing when stationary, some rotation is desirable for the angular shear it provides. The rotational speed however may be low. The mixer is not limited to polymers, and can be used in mixing foodstuffs, homogenizing milk, and preparation of emulsions.

We claim:

1. An extensional flow mixer suitable for high viscosity liquids such as plastic materials, comprising:

a housing (10) with a cylindrical cavity having a side wall (11);

an axial inlet (12*a*) into said cavity at one end of said housing and connectable to a pressurized source of the liquids;

an outlet (19) for the mixed liquids leading from the cavity, said outlet being at the center of an outlet end of the housing opposite said one end;

a first die member (20) in said cavity at said outlet end of said housing;

said first die member carrying annular concentric protrusions (20') surrounding a central aperture (20*a*) which communicates with the outlet;

a mandrel (30) located in said cavity, a second die member (32) fixed to said mandrel and carrying annular, concentric protrusions (32'), the protrusions of the first die member having inner edges symmetrically opposed inner edges of the second die member, and said protrusions having sloping side surfaces to divide the space between the die members into a series of annular chambers (C1,C2, . . . ) separated by annular slits between said inner edges, with said sloping side surfaces providing convergent entrances to, and divergent exits from, the slits;

means (22,23) for adjusting the position of one of said die members in the housing to alter the slit gaps;

characterized in that said mandrel has sides provided with helical grooves (34) and has radial passageways (36) connecting said helical grooves to said inlet, said grooves forming helical passageways with said side wall (11), said passageways communicating with outer edges of said die members for distributing the liquids around the edges of the die members.

2. A mixer according to claim 1, wherein at least four of said helical grooves (34) are provided.

3. A mixer according to claim 1, wherein said first die member (20) is mounted on holder means (18) having screw threaded engagement (23) with a portion of the housing, said holder means being rotatable so as to be movable axially within the housing and so as to adjust the slit gaps.

* * * * *